US012410001B2

(12) United States Patent
Wong

(10) Patent No.: US 12,410,001 B2
(45) Date of Patent: Sep. 9, 2025

(54) AEROSOL SPRAYING DEVICE

(71) Applicant: Hammond Wong, Yorba Linda, CA (US)

(72) Inventor: Hammond Wong, Yorba Linda, CA (US)

( * ) Notice: Subject to any disclaimer, the term of this patent is extended or adjusted under 35 U.S.C. 154(b) by 165 days.

(21) Appl. No.: 18/396,799

(22) Filed: Dec. 27, 2023

(65) Prior Publication Data

US 2025/0214763 A1 Jul. 3, 2025

(51) Int. Cl.
*B65D 83/24* (2006.01)
*B65D 83/206* (2025.01)
*B65D 83/22* (2006.01)

(52) U.S. Cl.
CPC ..... *B65D 83/24* (2013.01); *B65D 83/206* (2013.01); *B65D 83/22* (2013.01)

(58) Field of Classification Search
CPC ..... B65D 83/24; B65D 83/206; B65D 83/22
See application file for complete search history.

(56) References Cited

U.S. PATENT DOCUMENTS 3,934,761 A * 1/1976 Gentreau ..... B65D 83/386 222/402.13
4,079,862 A * 3/1978 Fegley ..... B65D 83/267 222/162
5,246,675 A * 9/1993 Castronovo ..... A01M 1/245 239/282
5,348,193 A * 9/1994 Bruckner ..... B65D 83/56 222/402.1
2007/0241134 A1* 10/2007 Gurrisi ..... B65D 83/384 222/402.11
2016/0175546 A1* 6/2016 Fishman ..... A61M 15/009 128/200.23
2017/0283158 A1* 10/2017 Schulz ..... B65D 47/2018
2025/0214763 A1* 7/2025 Wong ..... B65D 83/206

* cited by examiner

*Primary Examiner* — Bob Zadeh
(74) *Attorney, Agent, or Firm* — Walter J. Tencza, Jr.

(57) ABSTRACT

An apparatus including an aerosol container; and a spray device, located at a top of the aerosol container, configured to be placed into a locked state, wherein the spray device causes a material to be sprayed from the top of the aerosol container in the locked state. The apparatus may further include a housing in which the aerosol container is located. The apparatus may further include a ballast or balancing device configured to be located below the aerosol container, opposite the top of the aerosol container, and within the housing; and wherein when the aerosol container is located inside of the housing, and the ballast device is below the aerosol container, opposite the top of the aerosol container, and within the housing, the ballast device causes the housing to gradually change to an upright orientation after initially being placed on a flat ground surface in a non-upright orientation.

7 Claims, 15 Drawing Sheets

AEROSOL SPRAYING DEVICE

FIELD OF THE INVENTION

This invention relates to devices for using aerosol spray.

BACKGROUND OF THE INVENTION

There are various devices known in the art for using aerosol spray.

SUMMARY OF THE INVENTION

In at least one embodiment, an apparatus is provided comprising an aerosol container; and a spray device, located at a top of the aerosol container, which is configured to be placed into a locked state, wherein the device causes a material to be sprayed from the top of the aerosol container when the device is in the locked state.

The apparatus may further include a housing in which the aerosol container is located; and wherein the aerosol container is configured to be removed from the housing. The housing may have a first part and a second part; wherein the first part and the second part of the housing are configured to be connected together, with the aerosol container between the first part and the second part of the housing.

The apparatus may further include a ballast or balancing device configured to be located below the aerosol container, opposite the top of the aerosol container, and within the housing; and wherein when the aerosol container is located inside of the housing, and the ballast device is below the aerosol container, opposite the top of the aerosol container, and within the housing, the ballast device causes the housing to gradually change to an upright orientation after initially being placed on a flat ground surface in a non-upright orientation. The ballast device may be a concave disk.

In at least one embodiment of the present invention, a method is provided which may include tossing a device into a space so that the device lands on a ground surface of the space in a non-upright position; wherein the device is configured to automatically change orientation on the ground surface of the space from the non-upright position to an upright position; and wherein the device includes an aerosol container configured to spray material from the device.

The device may include a housing in which the aerosol container is located; and wherein the aerosol container is configured to be removed from the housing. The housing may have a first part and a second part; and wherein the first part and the second part of the housing are configured to be connected together, with the aerosol container between the first part and the second part of the housing.

The device may include a ballast or balancing device configured to be located below the aerosol container, opposite a top of the aerosol container, and within the housing; and wherein when the aerosol container is located inside of the housing, and the ballast device is below the aerosol container, opposite the top of the aerosol container, and within the housing, the ballast device causes the housing to gradually change to an upright orientation after initially being placed on a flat ground surface in a non-upright orientation. The ballast device may be a concave disk.

DETAILED DESCRIPTION OF THE DRAWINGS

Figure 1:
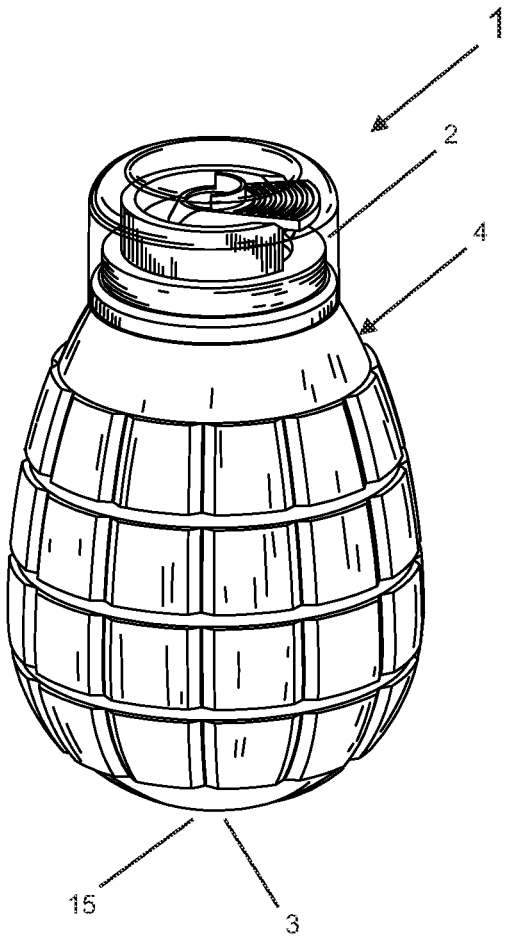
FIG. 1 shows a top and front perspective view of an apparatus in accordance with an embodiment of the present invention, with the apparatus shown in a fully assembled state, and with a cap or cover shown in a transparent form.

FIG. 1 shows a top and front perspective view of an apparatus 1 in accordance with an embodiment of the present invention, with the apparatus 1 shown in a fully assembled state, and with a cap or cover 2 shown in a transparent form. The apparatus 1 also includes a portion or device 4.

Figure 2:
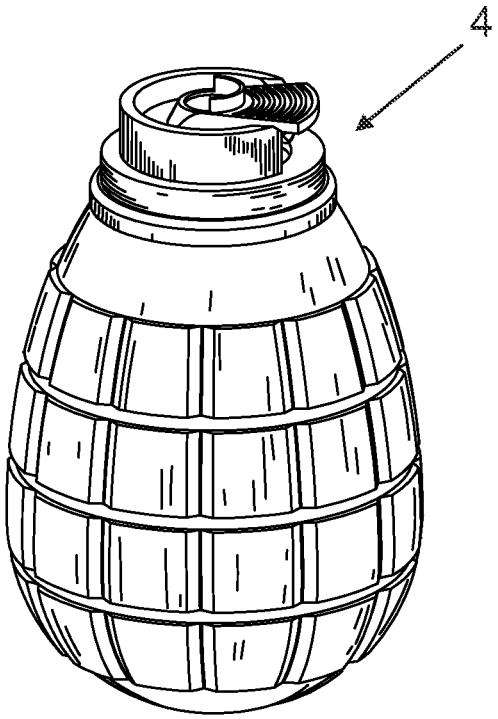
FIG. 2 shows a top and front perspective view of the apparatus of FIG. 1 in the fully assembled state, except for the cap or cover which has been removed.

FIG. 2 shows a top and front perspective view of the apparatus 1 of FIG. 1 in the fully assembled state, except for the cap or cover 2 which has been removed in FIG. 2, such that only portion or device 4 is shown.

Figure 3A:
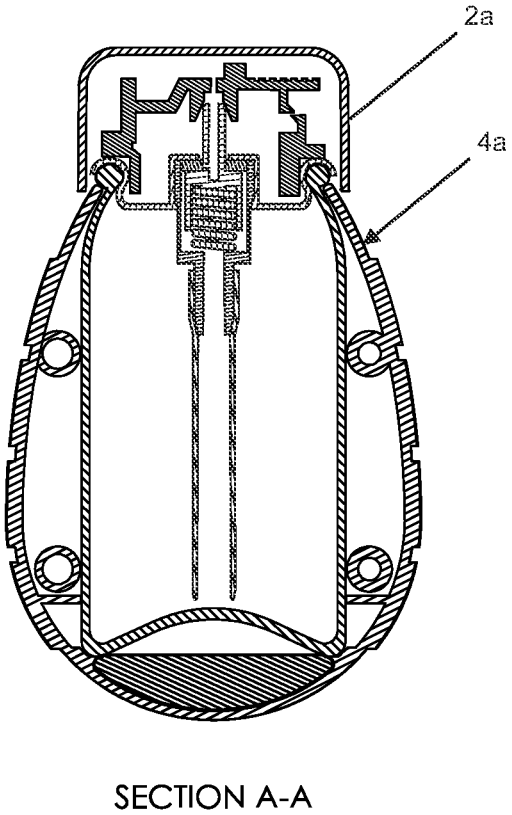
FIG. 3A shows a sectional view of a first portion of the apparatus of FIG. 1 in the fully assembled state.

FIG. 3A shows a sectional view of a first portion of the apparatus 1 of FIG. 1 in the fully assembled state. The view of FIG. 3A includes a portion 2*a* of the cap or cover 2 and a portion 4*a* of the portion or device 4 shown in FIG. 2.

Figure 3B:
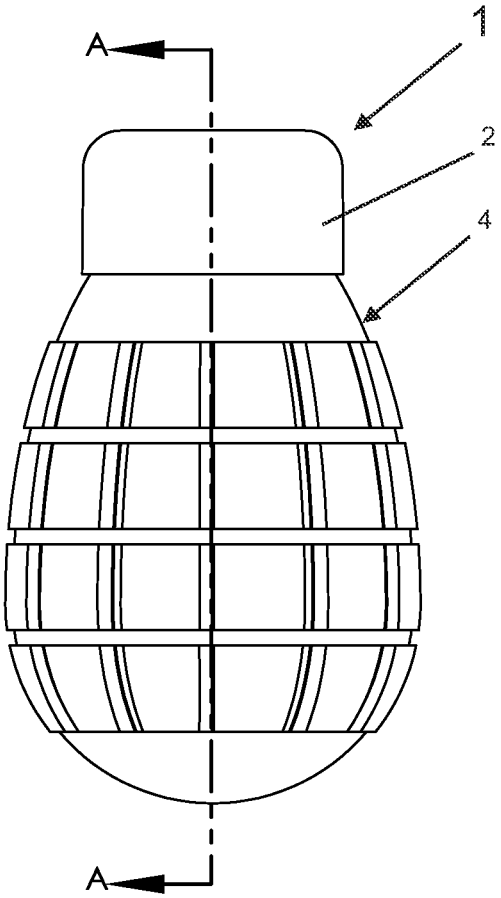
FIG. 3B shows a front view of the apparatus of FIG. 1 in the fully assembled state but with the cap or cover shown in an opaque form.

FIG. 3B shows a front view of the apparatus 1 of FIG. 1 in the fully assembled state but with the cap or cover 2 shown in an opaque form. FIG. 3B also shows the portion or device 4.

The sectional view of FIG. 3A has been taken along the line AA shown in FIG. 3B.

Figure 4:
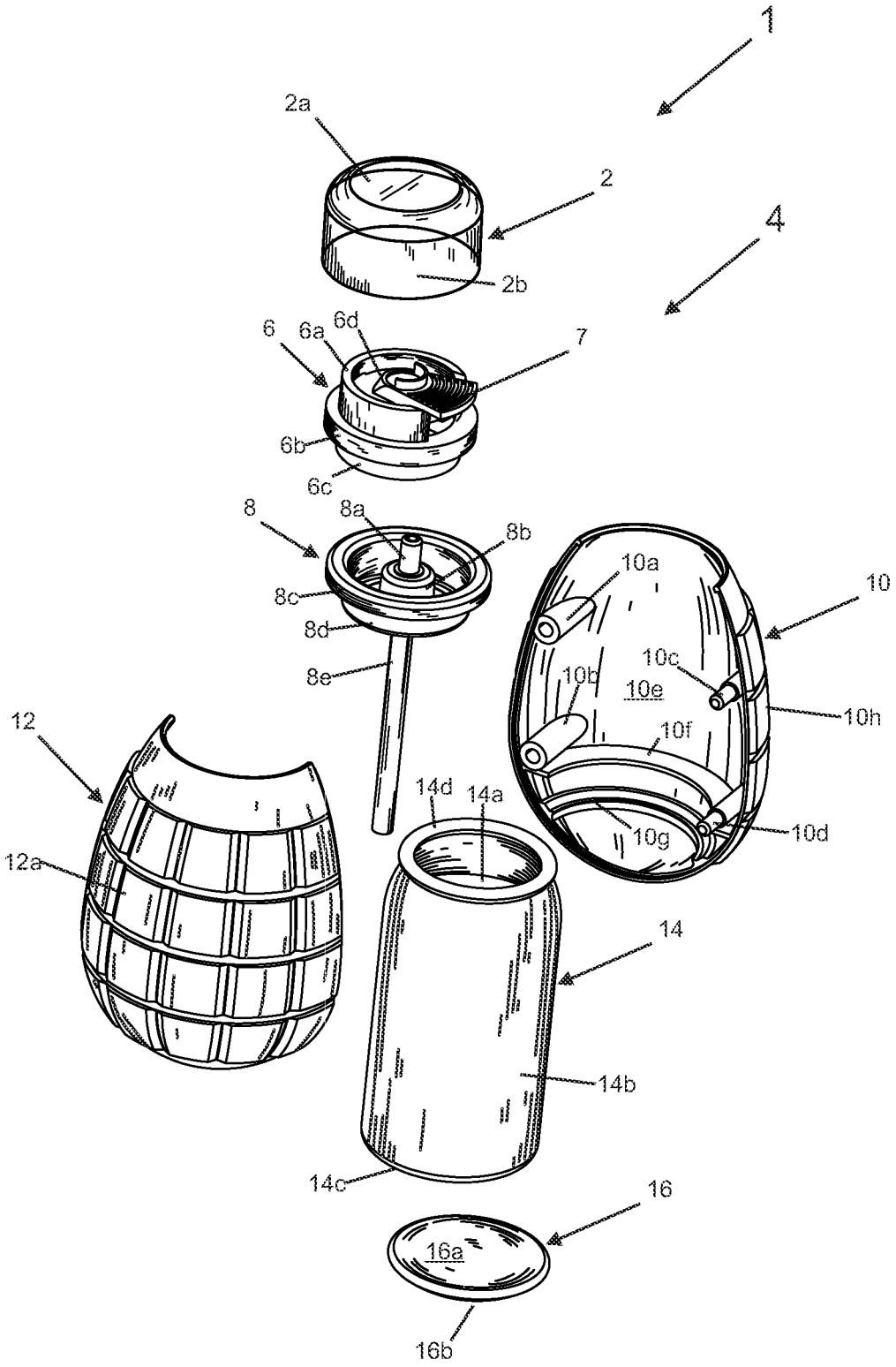
FIG. 4 shows perspective view of the apparatus of FIG. 1, wherein the apparatus of FIG. 1 has been taken apart into various components.

FIG. 4 shows perspective view of the apparatus 1 of FIG. 1, wherein the apparatus 1 of FIG. 1 has been taken apart into various components.

The apparatus 1 includes cap or cover 2, and device or portion 4. The device or portion 4 includes aerosol actuator 6, aerosol valve 8, a housing cover 10, a housing cover 12, aerosol can or container 14, and disc 16.

The cover 2 may include top 2*a* integrated with peripheral wall 2*b*, so that when cover 2 is located as in FIG. 1, the cover 2 provides a seal to prevent material from leaking from the device or portion 4. The cover 2 also helps to prevent the activation handle or wing 7 from being actuated and/or pressed downwards in the direction D1 shown in FIG. 9B, wherein 7' is part of wing 7.

The aerosol actuator 6 includes peripheral walls or portions 6*a*, 6*b*, and 6*c*. The aerosol actuator also includes an activation handle or wing 7.

The aerosol valve 8 includes a top tube 8*a*, peripheral walls or portions 8*a*, 8*b*, 8*c*, and 8*d*, and bottom tube 8*e*. The top tube 8*a* may be integrated with the bottom tube 8*e*.

The housing cover 10 may be made of plastic. The housing cover 10 may include cylindrical tubes 10*a*, 10*b*, 10*c*, and 10*d*, each of which has a bore or central opening. The housing cover 10 may further include ridge 10*f* and ridge 10*g*, which are used to affix and/or lock aerosol can or container 14 into position within housing covers 10 and 12.

The housing cover 10 may include protruding sections 10*h* on the outer surface of the housing cover 10. Each of the plurality of protruding sections 10*h* may be square or rectangular shaped.

The housing cover 12 may be configured to connect with the housing cover 10

The housing cover 12 may include protruding sections 12*a* on the outer surface of the housing cover 10, similar or identical to the protruding sections 10*h*.

Figure 9A:
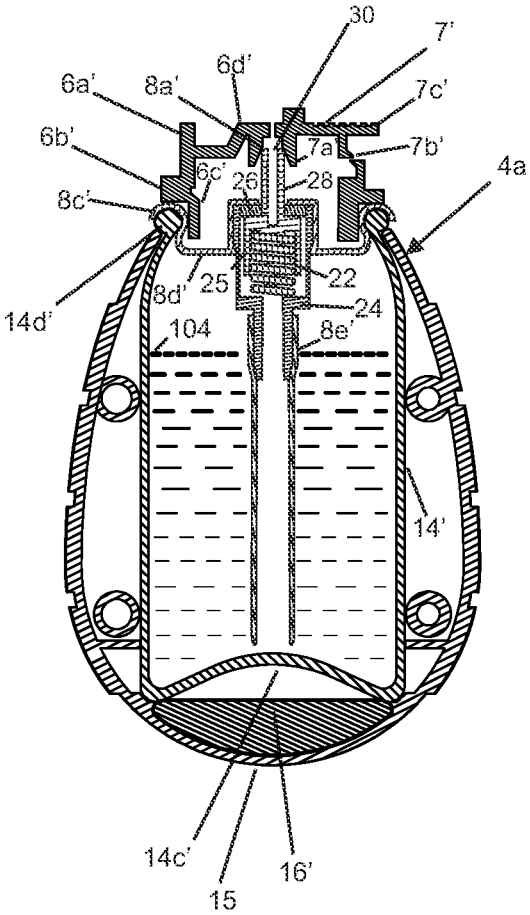
FIG. 9A shows a sectional view of the first portion of the apparatus of FIG. 1 in the fully assembled state, but without the cap or cover, and in a state where material is not being sprayed from the first portion of the apparatus.

The aerosol can or container 14 includes an opening 14*a*, a rim 14*d*, such as a rolled rim 14*d*, a cylindrical wall 14*b*, and a closed bottom 14*c*. The inner chamber of the container 14 is configured to hold a liquid 104 as shown by FIG. 9A.

The disc 16 may have an indented or curved top surface 16*a* and an outwardly curved bottom surface 16*b*.

Figure 5:
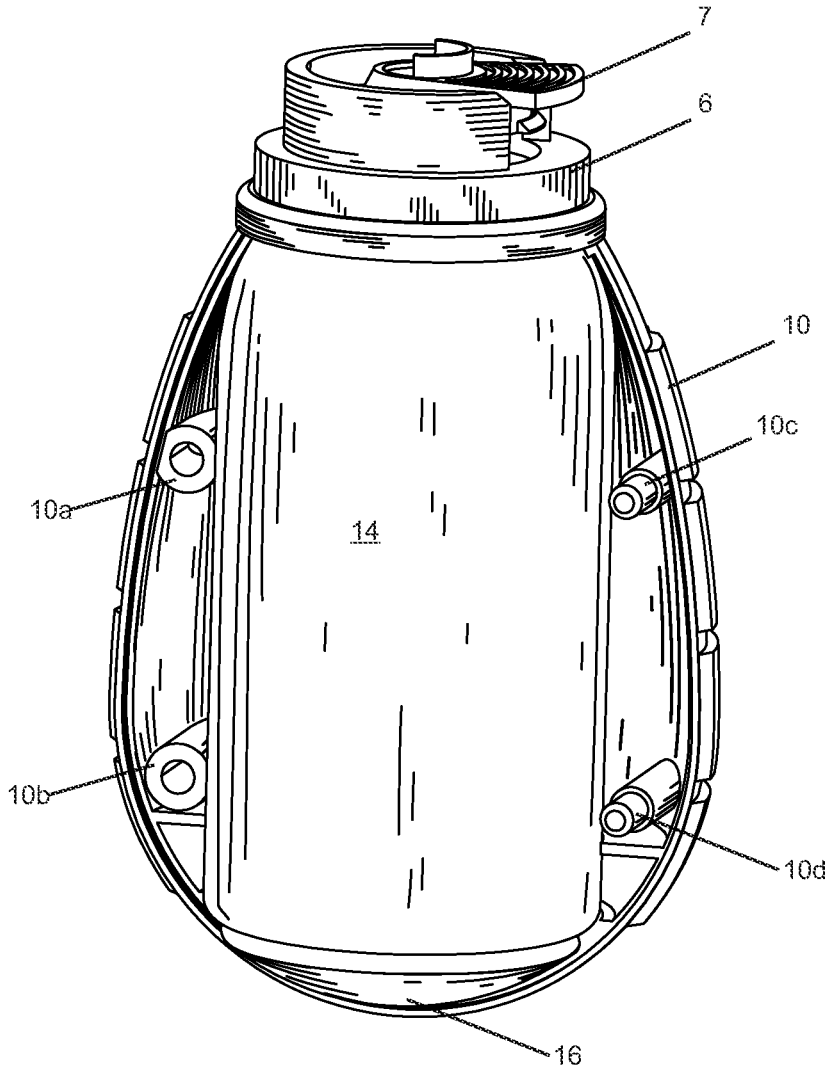
FIG. 5 shows a front and top perspective view of a second portion of the apparatus of FIG. 1 in the fully assembled state.

FIG. 5 shows a front and top perspective view of a portion of the apparatus 1 of FIG. 1 in the fully assembled state. In FIG. 5, the housing cover 10, the container 14, and the aerosol actuator 6 are visible. The housing cover 12 has been removed in FIG. 5, so that part of the inside of the apparatus 1 can be seen.

Figure 6:
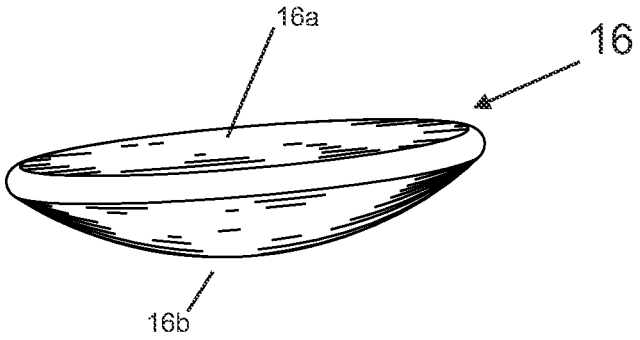
FIG. 6 shows a perspective view of a disc which is part of the apparatus of FIG. 1.

FIG. 6 shows a perspective view of the disc 16 which is part of the apparatus 1 of FIG. 1.

Figure 7A:
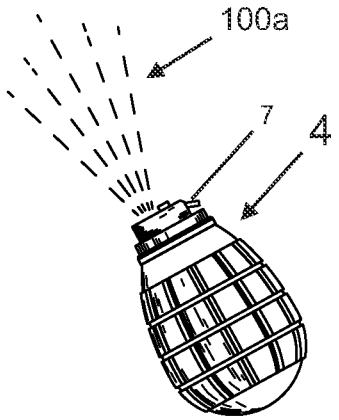
FIG. 7A is a front view of the apparatus of FIG. 1 in an assembled state, with the cap or cover removed, wherein an activation handle has been locked into activated position to cause a device of the apparatus to spray and with the shown portion of the apparatus of FIG. 1 tilted to the left so that a material is sprayed towards the left.

FIG. 7A is a front view of the portion or device 4 of the apparatus 1 of FIG. 1 in an assembled state, with the cap or cover 2 removed, and with the shown portion or device 4 of the apparatus 1 of FIG. 1 tilted to the left so that a material 100*a* is sprayed towards the left. In FIG. 7A the activation handle 7 has been pressed in the direction D1 (moving 7*b*' part of 7' which is part of activation handle 7) towards the bottom 14*c*' part of 14) as in FIG. 9B (wherein 7' is a part of 7), and locked into activated position to cause the device 4 of the apparatus 1 to spray.

Figure 7B:
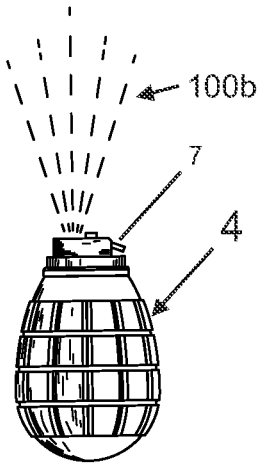
FIG. 7B is a front view of the apparatus of FIG. 1 in an assembled state, with the cap or cover removed, wherein an activation handle has been locked into activated position to cause the device of the apparatus to spray and with the shown portion of the apparatus of FIG. 1 standing straight up, so that a material is sprayed upwards.

FIG. 7B is a front view of the portion or device 4 of the apparatus 1 of FIG. 1 in an assembled state, with the cap or cover 2 removed, and with the shown portion or device 4 of the apparatus 1 of FIG. 1 standing straight up, so that a material 100*b* is sprayed upwards. In FIG. 7B the activation handle 7 has been pressed in the direction D1 (moving 7*b*' part of 7*b* towards the bottom 14*c*' part of 14) as in FIG. 9B (wherein 7' is a part of 7), and locked into activated position to cause the device 4 of the apparatus 1 to spray.

Figure 7C:
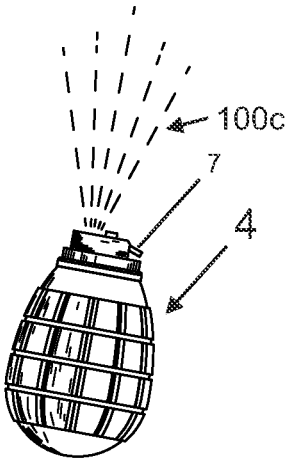
FIG. 7C is a front view of the apparatus of FIG. 1 in an assembled state, with the cap or cover removed, wherein an activation handle has been locked into activated position to cause the device of the apparatus to spray, and with the shown portion of the apparatus of FIG. 1 tilted to the right, so that a material is sprayed towards the right.

FIG. 7C is a front view of the portion or device 4 of the apparatus 1 of FIG. 1 in an assembled state, with the cap or cover 2 removed, and with the shown portion or device 4 of the apparatus 1 of FIG. 1 tilted to the right, so that a material 100*c* is sprayed towards the right. In FIG. 7C the activation handle 7 has been pressed in the direction D1 (moving 7*b*' part of 7*b* towards the bottom 14*c*' part of 14) as in FIG. 9B (wherein 7' is a part of 7), and locked into activated position to cause the device 4 of the apparatus 1 to spray.

Figure 8A:
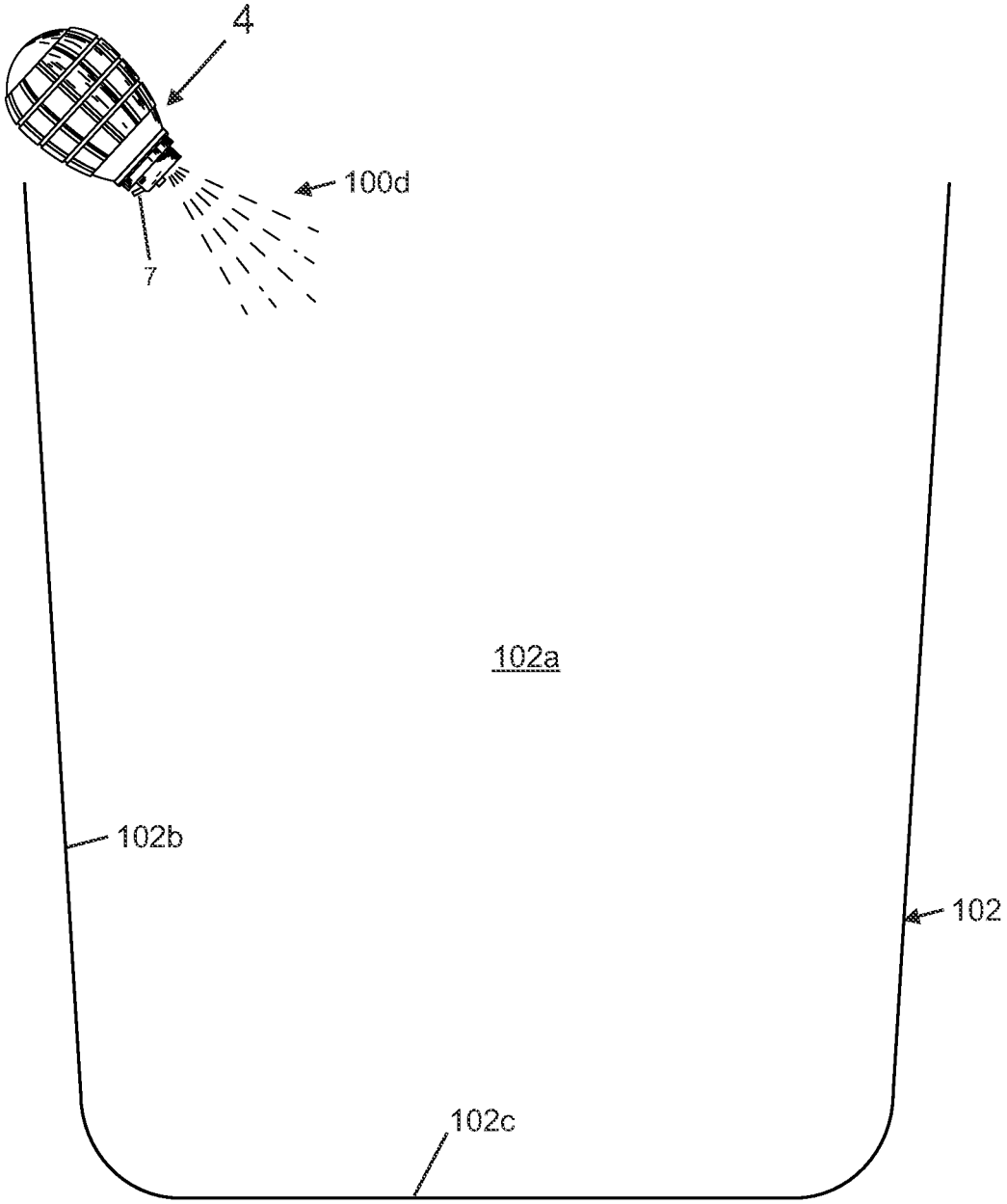
FIG. 8A is a front view of the apparatus of FIG. 1 in an assembled state, with the cap or cover removed, wherein an activation handle has been locked into activated position to cause the device of the apparatus to spray, and with the shown portion of the apparatus of FIG. 1, pointing down towards the right, so that material is sprayed towards the right and downwards into an inner chamber of a container.

FIG. 8A is a front view of the portion or device 4 of the apparatus 1 of FIG. 1 in an assembled state, with the cap or cover 2 removed, and with the shown portion or device 4 of the apparatus 1 of FIG. 1, pointing down towards the right, being thrown into an inner chamber 102*a* of a container 102, so that material 100*d* is sprayed towards the right and downwards into an inner chamber 102*a* of a container 102. The container 102 is shown in a simplified or outline form, but would typically have a cylindrical wall 102*b* with a closed bottom 102*c*. The container 102 may be a typical known kitchen garbage can or outdoor trash bin. However, in one or more embodiments of the present invention, the container 102 may be or may be replaced by any open space, such as within a household, a room, a car, or any other type of open space. In FIG. 8A the activation handle 7 has been pressed in the direction D1 (moving 7*b*' part of 7*b* towards the bottom 14*c*' part of 14) as in FIG. 9B (wherein 7' is a part of 7), and locked into activated position to cause the device 4 of the apparatus 1 to spray.

Figure 8B:
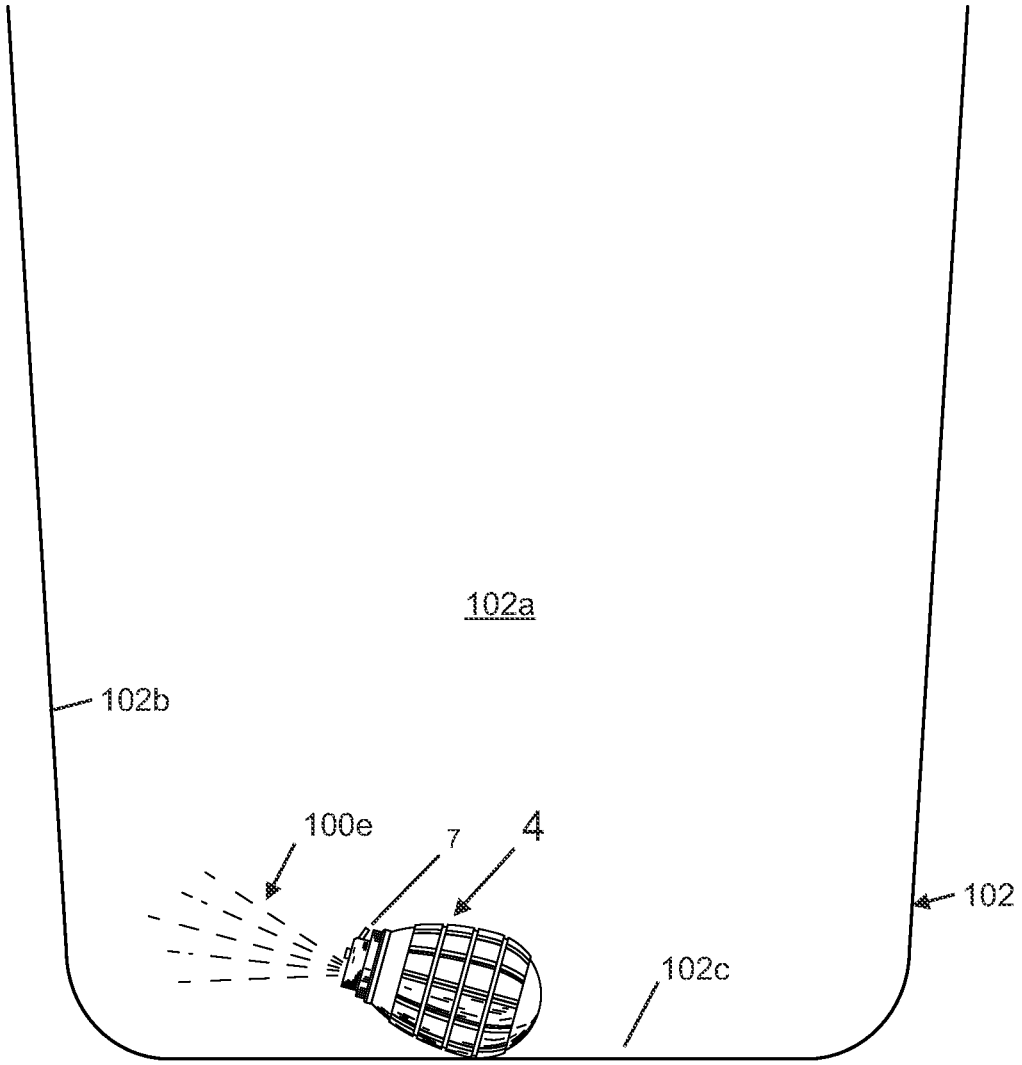
FIG. 8B is a front view of the apparatus of FIG. 1 in an assembled state, with the cap or cover removed, wherein an activation handle has been locked into activated position to cause the device of the apparatus to spray, and with the shown portion of the apparatus of FIG. 1, pointing towards the left so that material is sprayed towards the left inside of the inner chamber of the container.

FIG. 8B is a front view of the portion or device 4 of the apparatus 1 of FIG. 1 in an assembled state, with the cap or cover 2 removed, and with the shown portion or device 4 of the apparatus 1 of FIG. 1, pointing towards the left so that material 100*e* is sprayed towards the left inside the bottom of the inner chamber 102*a* of the container 102. In FIG. 8B the activation handle 7 has been pressed in the direction D1 (moving 7*b*' part of 7*b* towards the bottom 14*c*' part of 14) as in FIG. 9B (wherein 7' is a part of 7), and locked into activated position to cause the device 4 of the apparatus 1 to spray.

Figure 8C:
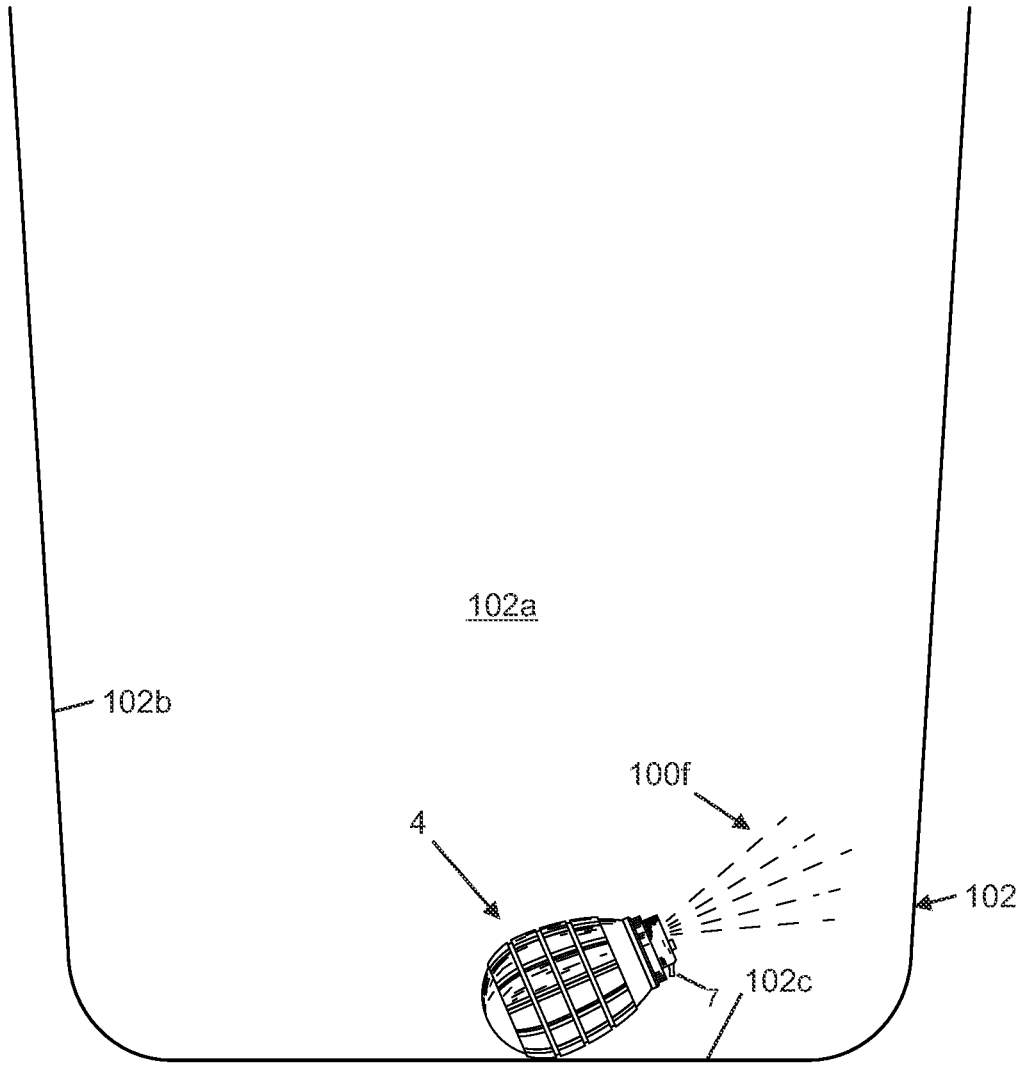
FIG. 8C is a front view of the apparatus of FIG. 1 in an assembled state, with the cap or cover removed, wherein an activation handle has been locked into activated position to cause the device of the apparatus to spray, and with the shown portion of the apparatus of FIG. 1, pointing towards the right so that material is sprayed towards the right inside of the inner chamber of the container.

FIG. 8C is a front view of the portion or device 4 of the apparatus 1 of FIG. 1 in an assembled state, with the cap or cover 2 removed, and with the shown portion or device 4 of the apparatus 1 of FIG. 1, pointing towards the right so that material 100*f* is sprayed towards the right inside the bottom of the inner chamber 102*a* of the container 102. In FIG. 8C the activation handle 7 has been pressed in the direction D1 (moving 7*b*' part of 7*b* towards the bottom 14*c*' part of 14) as in FIG. 9B (wherein 7' is a part of 7), and locked into activated position to cause the device 4 of the apparatus 1 to spray.

Figure 8D:
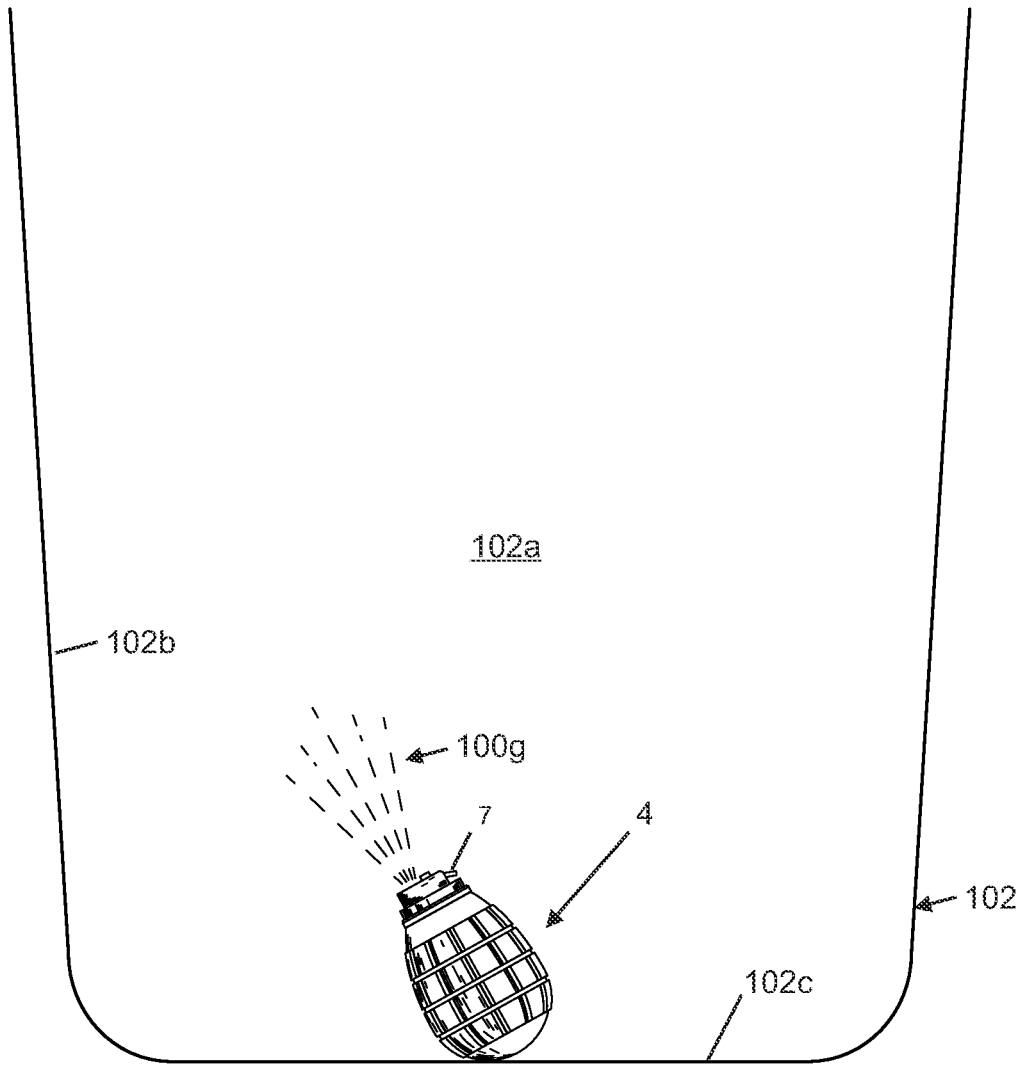
FIG. 8D is a front view of the apparatus of FIG. 1 in an assembled state, with the cap or cover removed, wherein an activation handle has been locked into activated position to cause the device of the apparatus to spray, and with the shown portion of the apparatus of FIG. 1, pointing towards the left and upwards so that material is sprayed towards the left side and upwards, inside of the inner chamber of the container.

FIG. 8D is a front view of the portion or device 4 of the apparatus 1 of FIG. 1 in an assembled state, with the cap or cover 2 removed, and with the shown portion of the apparatus 1 of FIG. 1, pointing towards the left and upwards so that material 100*g* is sprayed towards the left side and upwards, inside the bottom of the inner chamber 102*a* of the container 102. In FIG. 8D the activation handle 7 has been pressed in the direction D1 (moving 7*b*' part of 7*b* towards the bottom 14*c*' part of 14) as in FIG. 9B (wherein 7' is a part of 7), and locked into activated position to cause the device 4 of the apparatus 1 to spray.

Figure 8E:
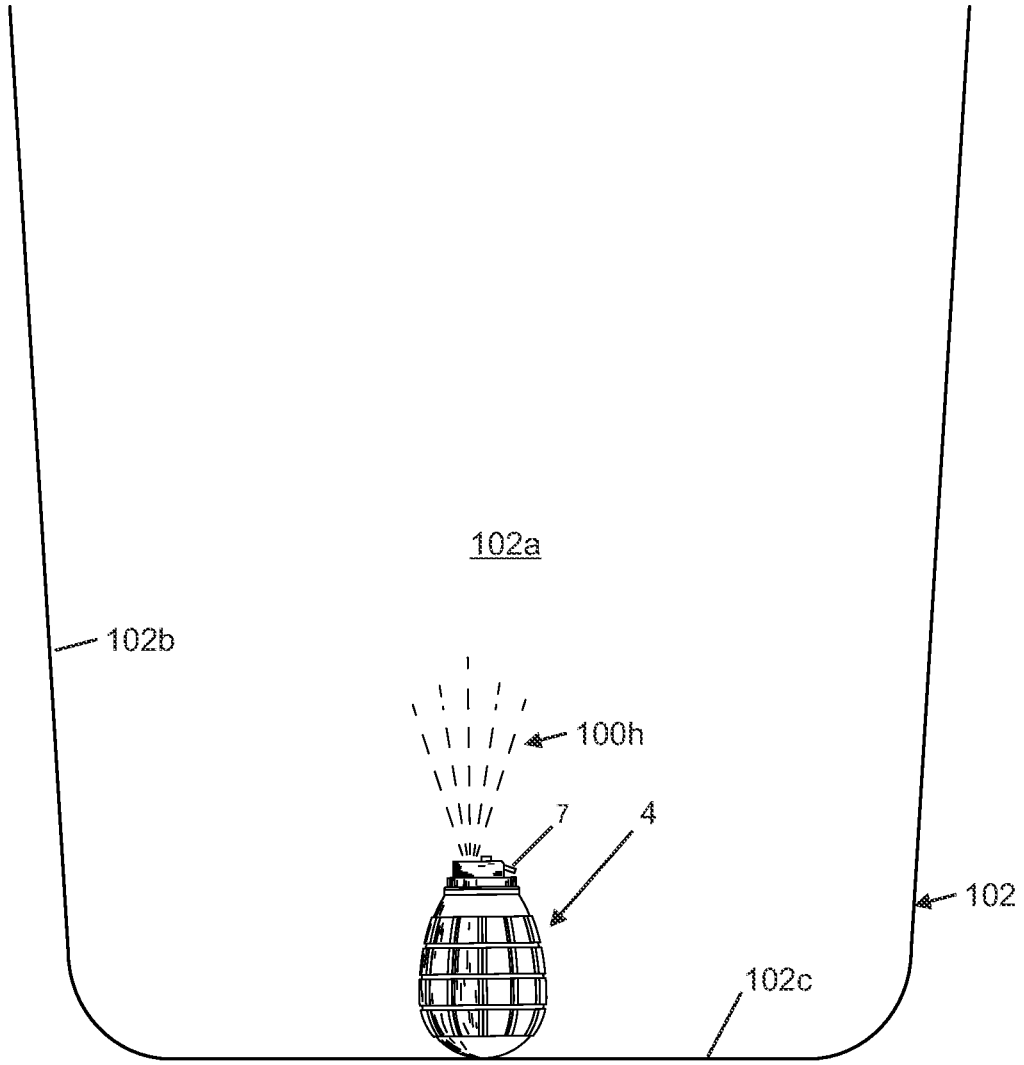
FIG. 8E is a front view of the apparatus of FIG. 1 in an assembled state, with the cap or cover removed, wherein an activation handle has been locked into activated position to cause the device of the apparatus to spray, and with the shown portion of the apparatus of FIG. 1, standing upright and so that material is sprayed upwards, inside of the inner chamber of the container.

FIG. 8E is a front view of the portion or device 4 of the apparatus 1 of FIG. 1 in an assembled state, with the cap or cover 2 removed, and with the shown portion or device 4 of the apparatus 1 of FIG. 1, standing upright and so that material 100*h* is sprayed upwards, inside the bottom of the inner chamber 102*a* of the container 102. In FIG. 8E the activation handle 7 has been pressed in the direction D1 (moving 7*b*' part of 7*b* towards the bottom 14*c*' part of 14) as in FIG. 9B (wherein 7' is a part of 7), and locked into activated position to cause the device 4 of the apparatus 1 to spray.

FIG. 9A shows a sectional view of a portion of the apparatus 1 of FIG. 1 in the fully assembled state, but without the cap or cover 2, and in a state where material is not being sprayed from the portion of the apparatus shown in FIG. 9A.

For purposes of ease of description, FIG. 9A, shows parts or portions 6*a*', 6*b*', 6*c*', 6*d*', of the corresponding components 6*a*, 6*b*, 6*c*, 6*d*, respectively. In addition, for ease of description, in FIG. 9A, the components 7', 7*a*', 7*b*', 7*c*', are identified which are part of the component 7. Furthermore, the components 8*a*', 8*b*', 8*c*', 8*d*', and 8*e*' are shown in FIG. 9A, which are part of components 8*a*, 8*b*, 8*c*, 8*d*, and 8*e*, respectively, as shown in FIG. 4. In addition, components 14', 14*c*', and 14*d*', shown in FIG. 9A are part of components 14, 14*c*, and 14*d*, respectively, such as shown in FIG. 4. I.e. because FIG. 9A is a sectional view it is missing part, such as about half of the various components.

Figure 9B:
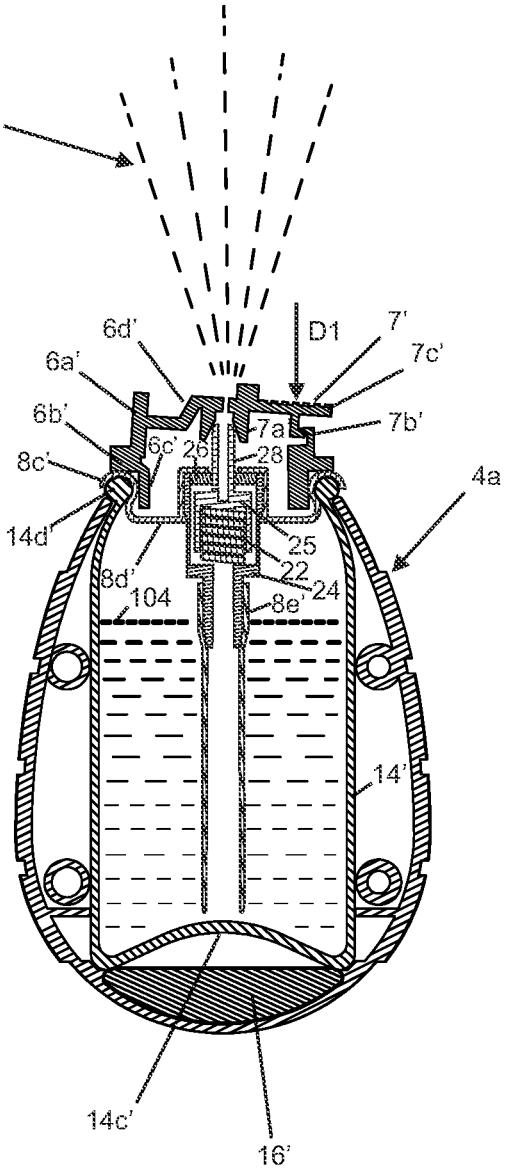
FIG. 9B shows a sectional view of the first portion of the apparatus of FIG. 1 in the fully assembled state, but without the cap or cover, and in a state where material is being sprayed upwards from the first portion of the apparatus.

FIG. 9B shows a sectional view of a portion of the apparatus 1 of FIG. 1 in the fully assembled state, but without the cap or cover 2, and in a state where material 100*i* is being sprayed upwards from the portion of the apparatus shown in FIG. 9B.

In operation, a person, uses one of their fingers to press downwards in the direction D1 shown in FIG. 9B, on the activation handle 7 (shown fully in FIG. 4, and partially as 7' in FIG. 9B). This causes the components 7, 6*a*, 6*d* (and corresponding parts 7', 7*a*', 7*b*', 7*c*', 6*a*', 6*b*', 6*c*' and 6*d*', respectively, shown in FIGS. 9A-B) to rotate clockwise, from FIG. 9A state to FIG. 9B state. This also causes the parts 7*a*' and bottom of 6*d*' (and components 7*a* and 6*d* to squeeze the top of tube part 8*e*' (and 8*e*) to cause liquid from liquid 104 to be sucked up through the bottom opening of 8*e*' and 8*e* (shown in FIG. 4), through 8*e* and out the top of 8*e*' and 8*e*, and out from the opening between parts 6*d*' and 7' (and 6*d* and 7, respectively) as spray material 100*i* as shown in FIG. 9B.

In at least one embodiment, the apparatus 1 is configured for one time use.

In at least one embodiment, the liquid 104 may be a chemical, such as an insecticide, deodorant, or fragrance.

In at least one embodiment, the act of spraying by use of device 4 is configured to be done by use of, at least, the tube 8*e* (and part 8*e*'), and/or with the actuator 6 (including component 7), and/or with a propellant added to the chemical or liquid 104.

In at least one embodiment, to assembled the device or portion 4, the aerosol can or container 14 (and part 14') is inserted into the cover 10 (or A side) as shown by FIG. 5 and FIG. 9A. The disc 16 (including section 16'), which may be solid concave and round, is inserted/positioned in the cover 10 below the bottom of the aerosol can or container 14 as shown in FIG. 5 and FIGS. 9A-B.

The housing cover 12 (or B side) is snapped into the cover 10 (or A side, but can do vice versa, i.e. housing cover 10 snapped into housing cover 12) to affix/position both aerosol can 14 and lead disc 16 into a case which includes housing cover 10 and housing cover 12.

The cap/cover 2 (which may be transparent) is then placed on the aerosol actuator 6 to prevent accidental activation of the device 4, as shown in FIG. 1.

In at least one embodiment, in order to use the device 4, the cap/cover 2 is removed from the device 4.

The device or aerosol assembly 4 is then activated by pressing down in the direction D1 shown in FIG. 9B on the activation handle/wing 7 (includes part 7') of the aerosol actuator 6. The activation handle/wing 7 in thereby locked in position and triggers the aerosol valve 8 to continuously release the chemicals/mist/fogger into air until the can is emptied.

By placing a solid concave round lead disc 16 below the bottom 14*c* of the container 14, the device becomes a tumbler. With the configuration of the round shape of the bottom of disk 16, the center of gravity of the weight is focused at the bottom center of the disk 16 and this in combination with the overall configuration of the device or portion 4, makes the location 15 shown in FIG. 9A, a pivot point 15, to ensure: (a) the fogging or spraying will only go upward; (b) the device or portion 4 will not lie down or go upside down thus affecting the flow of the fogging or spraying; and (c) the device or portion 4 moves in a circular motion through a pivot point 15, shown at the bottom center in FIG. 9A which allows fogging or spraying to go both upward and/or in circular motion to widen the fogging or spraying area as will be explained with reference to FIG. 11.

Figure 10:
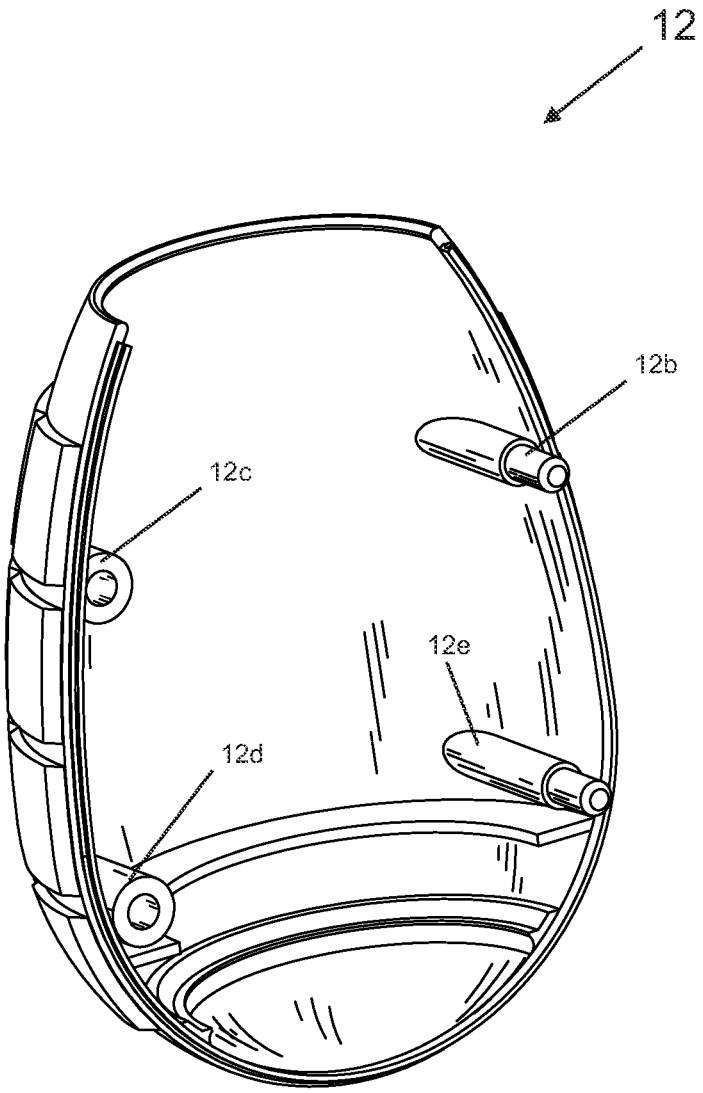
FIG. 10 shows an inside perspective view of a first housing cover, which is configured to connect to a second housing cover, to house various components of the apparatus of FIG. 1.

FIG. 10 shows an inside perspective view of a housing cover 12, which is configured to connect to a housing cover 10, to house various components of the apparatus 1 of FIG. 1. In at least one embodiment, after the container 14 and a solid concave round lead disc 16 are inserted, at least partially, into the housing cover 10 as shown in FIG. 5, the housing cover 12 is connected to the housing cover 10, such as by simultaneously inserting the tube 12*b* (shown in FIG. 10) into the opening and bore of the tube 10*a* (shown in FIG. 5), the tube 12*e* (shown in FIG. 10) into the bore and opening of the tube 10*b* (shown in FIG. 5), the tube 10*c* (shown in FIG. 5) into the bore and opening of the tube 12*c* (shown in FIG. 10), and the tube 10*d* (shown in FIG. 5) into the bore and opening of the tube 12*d* (shown in FIG. 10). In at least one embodiment, this snap connects the housing covers 10 and 12 together, with the container 14 between the housings 10 and 12.

Figure 11:
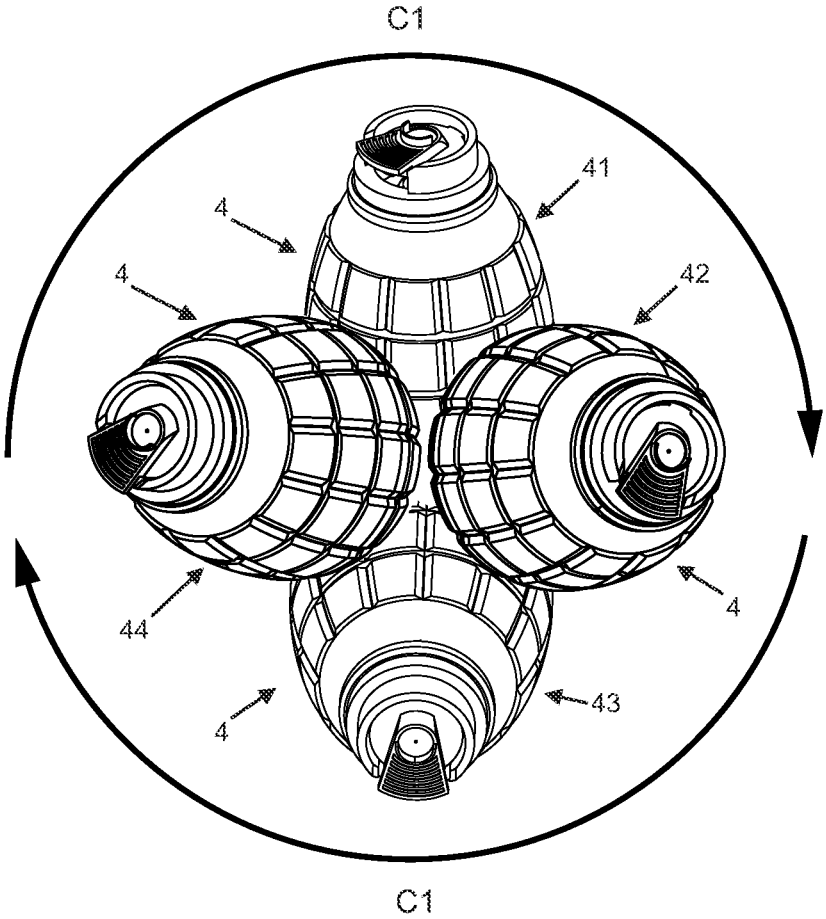
FIG. 11 shows a top view simplified diagram to describe spinning circular motion movement of the device of the apparatus of the present invention, in at least one embodiment.

FIG. 11 shows a top view simplified diagram to describe spinning circular motion movement of the device 4 of the apparatus of the present invention, in at least one embodiment. FIG. 11 shows four, at least, partial images of the device 4 of the apparatus 1 at different instances in time, as the device 4 is spinning in a circular motion movement in the clockwise direction C1. FIG. 11 shows images 41, 42, 43, and 44 of the device 4 at different points in time during motion. At a first instant of time, shown by image 41, the device 4 is oriented with its top pointed upwards or northwards so that if spray is emitted, it would be emitted upwards or northwards, or substantially upwards or northwards. At a second instant of time, shown by image 42, the device 4 is oriented with its top pointed rightwards or eastwards so that if spray is emitted, it would be emitted rightwards or eastwards, or substantially rightwards or eastwards. At a third instant of time, shown by image 43, the device 4 is oriented with its top pointed downwards or southwards so that if spray is emitted, it would be emitted downwards or southwards, or substantially downwards or southwards. At a fourth instant of time, shown by image 44, the device 4 is oriented with its top pointed leftwards or westwards so that if spray is emitted, it would be emitted leftwards or westwards, or substantially leftwards or westwards.

In at least one embodiment, the device 4 of the apparatus 1 is configured so that when the device 4 is thrown, the device 4 is configured to have a tendency to land on a flat ground surface, on its bottom 3, at or substantially near the center or pivot point 15, shown in FIG. 1, due, at least in part, to the weight and configuration provided by the disk 16 (shown in FIG. 4). In at least one embodiment, the disk 16, weighs 45.0 grams, and this weight, in combination with the weight of other components of the device 4, helps to provide the appropriate ballast, to make the device 4 have the tendency to eventually stand upright after initially being placed in a non-upright orientation. In relation to rest of device 4 of apparatus 1), and after landing (wherein in landing the bottom 3 typically contacts the flat ground surface or any surface) the device 4 is configured to have a tendency to spin and/or move in the manner shown in FIG. 11, until the device 4 gradually comes to a stop, in an upright position, as shown in FIG. 8E.

In at least one embodiment, as shown in FIGS. 9A and 9B, the device 4, and portion 4*a* of the device 4 may include a spring 22, a housing 24, a gasket 26, and a stem 28, and/or portions of which are shown by sectional views in FIGS. 9A and 9B. In at least one embodiment, when component 7' (and 7) is pressed down, the components 7' and 7, bring 6*d*' down and lock into component 7*b*. This will move 8*b*' downward and separate it from the gasket or foam pad 26 (which acts as stopper to close the opening 30, at the top of stem 28) and allows the opening 30 to open in FIG. 9B, which further allows propellant/chemical/mist 104 to come out of the container 14, (includes 14'), though bottom of tube 8*e*', up through tube 9*e*' into housing 24, up between housing 24 and housing 25 (in open state of FIG. 9B), through stem tube 28 and out through opening 30. The spring 22 is compressed in FIG. 9B and is biased so that when force is not being applied in the direction D1, as in FIG. 9A, spring 22 causes the component 7' and 7 to return to steady state, and the opening 30 to close. The spring 22 is biased to push upward opposite the direction D1 to close the opening 30, (closed state shown in FIG. 9A) by using gasket 26, and this prevents chemical 104 from leaking out of container 14.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

an aerosol container; and a spray device, located at a top of the aerosol container, which is configured to be placed into a locked state, wherein the spray device causes a material to be sprayed from the top of the aerosol container when the spray device is in the locked state; and further comprising a housing in which the aerosol container is located; and wherein the aerosol container is configured to be removed from the housing; and further comprising:

a ballast device configured to be located below the aerosol container, opposite the top of the aerosol container, and within the housing; and wherein when the aerosol container is located inside of the housing, and the ballast device is below the aerosol container, opposite the top of the aerosol container, and within the housing, the ballast device causes the housing to gradually change to an upright orientation after initially being placed on a flat ground surface in a non upright orientation.

2. The apparatus of claim 1 wherein the housing has a first part and a second part;

wherein the first part and the second part of the housing are configured to be connected together, with the aerosol container between the first part and the second part of the housing.

3. The apparatus of claim 1 wherein the ballast device is a concave disk.

4. A method comprising tossing a device into a space so that the device lands on a flat ground surface of the space in a non-upright position;

wherein the device is configured to automatically change orientation on the flat ground surface of the space from the non-upright position to an upright position;

wherein the device includes an aerosol container configured to spray material from the device;

wherein the device includes a housing in which the aerosol container is located;

wherein the aerosol container is configured to be removed from the housing;

wherein the device includes a ballast device configured to be located below the aerosol container, opposite a top of the aerosol container, and within the housing; and wherein when the aerosol container is located inside of the housing, and the ballast device is below the aerosol container, opposite the top of the aerosol container, and within the housing, the ballast device causes the housing to gradually change to the upright orientation after initially being placed on the flat ground surface in the non upright orientation.

5. The method of claim 4 wherein the housing has a first part and a second part;

wherein the first part and the second part of the housing are configured to be connected together, with the aerosol container between the first part and the second part of the housing.

6. The method of claim 4 wherein the ballast device is a concave disk.

7. The method of claim 4 wherein the device includes a spray device which is configured to be placed into a locked state in such that the spray device causes a material to be sprayed from a top of the aerosol container when the spray device is in the locked state.

* * * * *